US007475708B2

(12) United States Patent
Bruske et al.

(10) Patent No.: US 7,475,708 B2
(45) Date of Patent: Jan. 13, 2009

(54) SHAFT DRIVE FOR HEALD SHAFTS OF WEAVING MACHINES

(75) Inventors: Johannes Bruske, Albstadt (DE); Bernhard Münster, Messtetten (DE); Armin Fäller, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 144 days.

(21) Appl. No.: 11/367,271

(22) Filed: Mar. 6, 2006

(65) Prior Publication Data

US 2006/0144459 A1 Jul. 6, 2006

(30) Foreign Application Priority Data

Mar. 7, 2005 (DE) ..... 10 2005 010 807

(51) Int. Cl.

| | |
|---|---|
| ***D03D 51/46*** | (2006.01) |
| ***D03C 9/06*** | (2006.01) |
| *D03C 15/00* | (2006.01) |
| *D03D 51/02* | (2006.01) |

(52) U.S. Cl. ..... 139/55.1; 139/1 E; 139/59; 139/66 A; 139/76; 139/455

(58) Field of Classification Search ..... 139/1 E, 139/55.1, 76, 66 A, 59, 66 R, 82, 455, 97, 139/105, 106, 340, 349

See application file for complete search history.

(56) References Cited

U.S. PATENT DOCUMENTS

| | | | | | |
|---|---|---|---|---|---|
| 3,807,460 | A | * | 4/1974 | Alexandr et al. | 139/76 |
| 3,865,147 | A | * | 2/1975 | Lev et al. | 139/1 E |
| 4,314,588 | A | * | 2/1982 | Speich | 139/79 |
| 4,385,649 | A | * | 5/1983 | Sevcik | 139/435.3 |
| 4,387,741 | A | * | 6/1983 | Palau et al. | 139/66 R |
| 4,427,035 | A | * | 1/1984 | Hintsch et al. | 139/76 |
| 4,444,225 | A | * | 4/1984 | Palau et al. | 139/66 R |
| 4,542,769 | A | * | 9/1985 | Julich | 139/66 R |
| 4,544,000 | A | * | 10/1985 | Bourgeaux | 139/66 R |
| 4,557,298 | A | * | 12/1985 | Froment | 139/71 |
| 4,730,641 | A | * | 3/1988 | Schwarz | 139/76 |
| 4,776,372 | A | * | 10/1988 | Surkamp | 139/76 |
| 4,858,655 | A | * | 8/1989 | Palau et al. | 139/76 |
| 4,905,738 | A | * | 3/1990 | Kleiner | 139/76 |
| 4,986,315 | A | * | 1/1991 | Borisch et al. | 139/66 R |

(Continued)

FOREIGN PATENT DOCUMENTS

DE 697 02 039 T2 9/2000

(Continued)

*Primary Examiner*—Bobby H Muromoto, Jr.
(74) *Attorney, Agent, or Firm*—Norman N. Kunitz; Fitch, Even, Tavin & Flannery

(57) ABSTRACT

A new shaft drive provides for a switch-on and switch-off of individual heald shafts even at high working speeds. For this purpose switching pawls are provided which couple an eccentric with permanently revolving and/or back-and-forth oscillating disks. Measures for improving the controllability of such a clutch device are the control of the switching pawls by slot guides, associating bi-stabile biasing devices with the switching pawls and/or dividing the switching function into individual switching pawls (27*a*, 27*b*) which are associated individually with differently running disks (21, 22). Preferably, one of the two disks executes a continuous rotary motion, while the respective other disk performs only an oscillating motion which determines the heald shaft motion during the resting phases thereof.

18 Claims, 13 Drawing Sheets

U.S. PATENT DOCUMENTS

| | | | | | |
|---|---|---|---|---|---|
| 5,069,256 | A | * | 12/1991 | Goodman, Jr. | 139/83 |
| 5,107,901 | A | * | 4/1992 | Pages et al. | 139/76 |
| 5,125,434 | A | * | 6/1992 | Froment | 139/66 R |
| 5,251,672 | A | * | 10/1993 | Froment et al. | 139/82 |
| 5,255,719 | A | * | 10/1993 | Froment | 139/82 |
| 5,479,964 | A | | 1/1996 | Burigana | |
| 5,642,757 | A | * | 7/1997 | Froment et al. | 139/1 E |
| 5,653,268 | A | * | 8/1997 | Burkert | 139/79 |
| 5,671,781 | A | * | 9/1997 | Palau | 139/59 |
| 5,685,346 | A | * | 11/1997 | Froment et al. | 139/57 |
| 5,755,267 | A | * | 5/1998 | Eberhard et al. | 139/1 E |
| 5,797,433 | A | * | 8/1998 | Matas Gabalda | 139/449 |
| 5,908,050 | A | * | 6/1999 | Froment et al. | 139/66 R |
| 5,908,051 | A | * | 6/1999 | Froment et al. | 139/66 R |
| 5,918,645 | A | * | 7/1999 | Froment et al. | 139/66 R |
| 6,293,315 | B1 | * | 9/2001 | Froment et al. | 139/55.1 |
| 6,682,250 | B2 | * | 1/2004 | Banks | 403/4 |
| 6,938,647 | B2 | * | 9/2005 | Pages et al. | 139/66 R |
| 7,114,527 | B2 | * | 10/2006 | Von Zwehl et al. | 139/1 E |
| 7,140,399 | B2 | * | 11/2006 | Bruske et al. | 139/55.1 |
| 2004/0011417 | A1 | * | 1/2004 | Pages et al. | 139/76 |
| 2005/0056334 | A1 | * | 3/2005 | Bruske et al. | 139/91 |

FOREIGN PATENT DOCUMENTS

| | | |
|---|---|---|
| EP | 0 467 444 | 1/1992 |
| EP | 0 607 632 | 7/1994 |
| EP | 0 851 045 | 7/1998 |
| EP | 1 516 947 | 3/2005 |

* cited by examiner

SHAFT DRIVE FOR HEALD SHAFTS OF WEAVING MACHINES

CROSS REFERENCE TO RELATED APPLICATION

This application claims the priority of German Patent Application No. 10 2004 055 381.5, filed on Nov. 17, 2004, the subject matter of which, in its entirety, is incorporated herein by reference.

BACKGROUND OF THE INVENTION

This invention relates to a shaft drive for at least one heald shaft of a weaving machine.

For shed building in weaving machines, as a rule, several heald shafts are provided, each having a plurality of mutually parallel-arranged healds. The warp yarns are passed through the yarn eyelets of the healds. For shed building, the heald shafts are moved very rapidly up and down. For this purpose shaft drives are provided which are designated as shaft machines or eccentric machines. Eccentric machines generate an upward and downward motion of the heald shafts from the rotary motion, making possible high weaving speeds. However, such eccentric machines are inflexible. The production of patterns or various textures is feasible only in a limited manner. For this reason shaft drives are widely used where a pawl coupling is provided between the drive shaft and the eccentric for generating the heald shaft motion.

Such a shaft machine is known, for example, from German Patent Document 697 02 039 T2. The pawl switching mechanism provided between the eccentric and the drive shaft is, for each heald shaft motion, that is, for an upward motion of the heald shaft or a downward motion thereof, switched on for one half revolution of the drive shaft. Such shaft machines are very flexible. However, for the functioning of the pawl switching mechanism of such a shaft machine it is required that the entire drive, including all driving and driven elements, as well as the heald shaft, must be stationary during the switching phase. Shaft machines according to the above patent document thus perform switching in a stationary (detent) state.

It is accordingly the object of the invention to provide a shaft drive having a pawl switching mechanism which, since it switches during motion, makes possible high working speeds.

SUMMARY OF THE INVENTION

This object is achieved with a shaft drive defined in claims 1 and 2:

The shaft drive includes a clutch device which has at least one driving disk for executing a predetermined (for example, a uniform) rotary motion. A second driving disk may be provided which performs a rotary oscillating motion. Such a motion is, in selected angle ranges, for a short period of time fully or almost fully in synchronism with the first driving disk. These short phases of synchronous motion between the two driving disks may be utilized for switching the drive connection to the driven disk from the first driving disk over to the second driving disk and conversely. For this purpose one or more switching pawls are provided.

The switching pawl is engaged and disengaged by an actuating device. The latter is, for example, a slider which may be displaced between two positions. The switching pawl passes by the slider and is actuated according to the slider position. The actuating device may also be formed by at least one, but preferably by two switching levers. The switching pawl passes by the switching levers and is thus actuated (for example, engaged) thereby. For the temporary connection of the actuating device with the switching pawl, preferably a slot guide is proved. The latter ensures that the moving switching pawl, for example, revolving together with the driven disk, may be displaced freely in the circumferential direction and further, the slot guide transmits the radially directed switching motion to the switching pawl.

The slider may be actuated by a driven rotary cam with which the slider is in contact by means of a cam follower. The switching levers may be actuated directly by electrical or pneumatic means. It is, however, preferred to drive the switching levers from a cam drive with the intermediary of a control clutch. The latter may be operated with very little power, while sufficiently large forces are generated for moving the switching levers. The switching clutch may be controlled, for example, by stationary or movable control magnets and may be formed by an oscillatingly driven selector finger. Such an arrangement results in an accurately responding clutch control device which may be controlled with small energy input.

The switching pawl may be biased by a biasing device into its engaged or disengaged position and, if desired, it may be moved by the actuating device into its engaged or disengaged position.

A particularly rapidly responding pawl switching mechanism, characterized by a stabile operation, is obtained by providing that the biasing device is a bi-stabile device having two stabile switching positions. Between such two positions a dead-center position may be provided. In such a case, for the switch-over operation, the actuating device needs only to move the switching pawl beyond its dead center, whereupon the switching pawl switches over. Such an operation may be ensured even at very high working speeds, despite the shocks to which the entire mechanism is exposed and the oscillations and centrifugal forces resulting therefrom.

It is also considered to be advantageous to switch over the switching pawl by an actuating device which is provided with a slot guide for the switching pawl. In this arrangement it is sufficient if the switching pawl or a cam follower element coupled to the switching pawl enters into engagement with the slot guide only in the switch-over zones, that is, in those angle regions of the switching pawls revolving with the driven disk, in which a switch-over step is to be expected. These angle ranges correspond to the upper and lower dead center of the heald shaft.

The switching pawl may be structured as a rocker-like component and may be provided with two switching lugs. One switching lug is associated with a first driving disk and the other is associated with a second driving disk. In this manner the switching pawl may serve to establish selectively a driving connection between the first driving disk and the driven disk or the second driving disk and the driven disk. The switching pawl may be structured as a rigid rocker whose pivot pin is connected with the driven disk. As a variant, the rocker may be a two-part component having a resiliently supported arm.

In a particularly advantageous embodiment of the invention two mutually separated switching pawls are provided. In this manner a first switching pawl may be associated with the first driving disk and the second switching pawl may be associated with the second driving disk. In this arrangement the switching pawls are preferably disposed at diametrically opposite sides of the driven disk. The switching pawls may be resiliently biased toward their engagement position or, as described earlier, they may be connected with a bi-stabile biasing device having the earlier-noted advantages. The embodiment having two switching pawls has the advantage that the switching motions of a respective switching pawl may be set to be independent from the switching motions of the other switching pawl. This too, is of advantage for obtaining reliable higher operating and switching speeds.

In case the driven disk is coupled to the first driving disk, the heald shaft executes its back-and-forth motion. If, however, the driven disk is coupled to the second driving disk which only oscillates about a limited angle, the heald shaft is in its resting phase in which it executes only a slight oscillating motion about its upper or lower point of reversal. During such an oscillating motion, however, the heald shaft may be engaged during the short synchronous phases; the acceleration forces imparted on the heald shaft and the participating driving elements and the resulting stresses are barely greater than in case of an uninterrupted operation of the heald shaft. In any event, no appreciable abrupt changes in the acceleration forces appear.

The oscillating motion of the second driving disk may be generated by a cam drive or by electric, hydraulic or pneumatic drives.

Preferably, the drive imparts on the heald shaft a continuing motion not only during its motion phases, but also during its resting phases in which, in conventional arrangements, the heald shaft is at a standstill in the upper or lower point of reversal. This offers the possibility to reduce the maximum accelerations of the heald shaft. The avoidance of abrupt acceleration increases leads to a shock-free run of the heald shafts. Such a run, even at high working speeds, does not lead to excessive excitation of oscillations. The limit for the working speed in which heald shaft breakages and heald breakages occur, may thus be shifted to significantly higher working speeds.

Further details of preferred embodiments of the invention appear in the drawing, the specification or the claims.

DETAILED DESCRIPTION OF THE INVENTION

Figure 1:
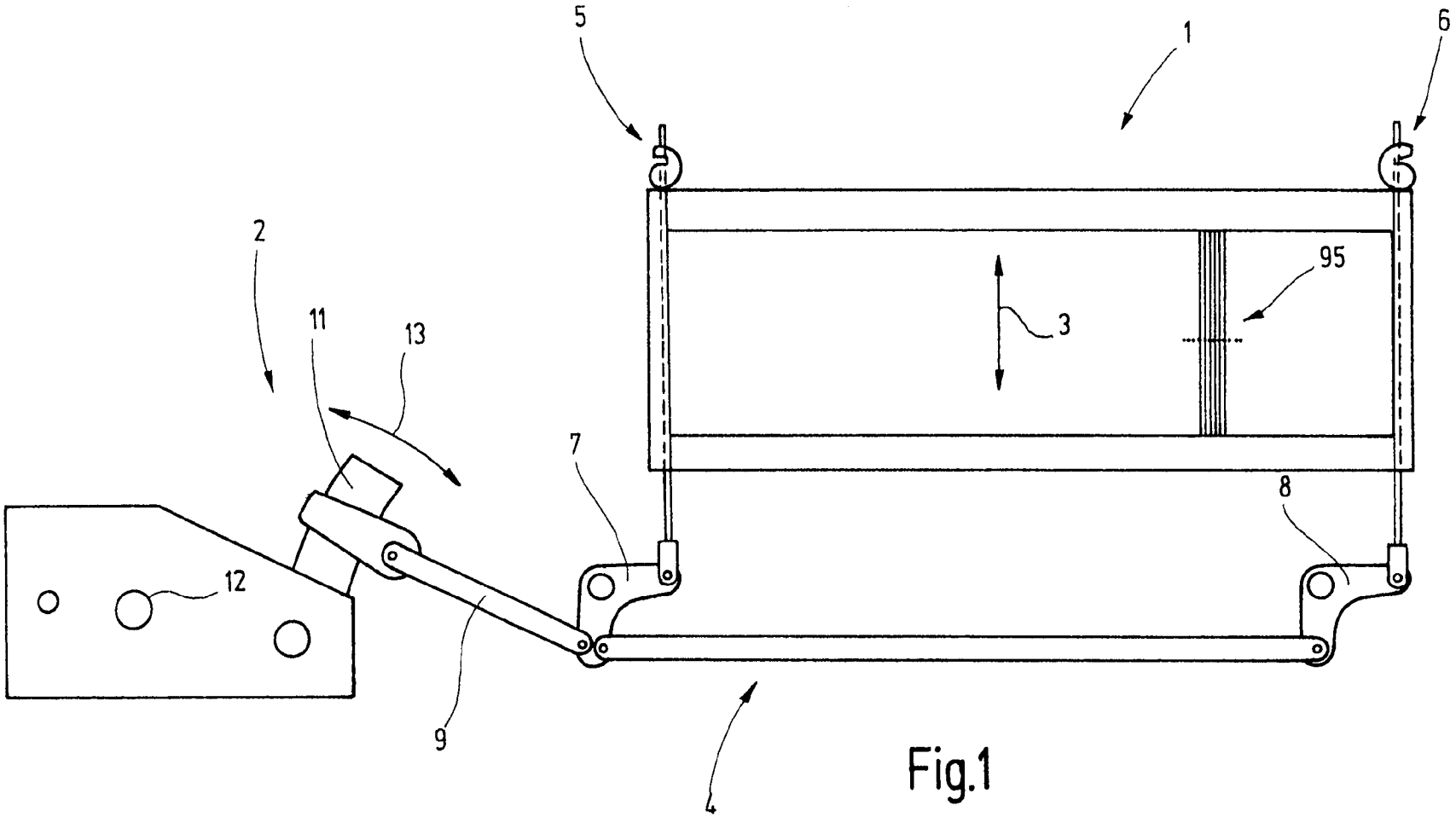
FIG. 1 is a schematic illustration of a heald shaft associated with a mechanical shaft drive.

FIG. 1 shows a heald shaft 1 and a shaft drive 2 associated therewith. The heald shaft 1 is formed by a frame which is provided with healds 95 and which is reciprocated up and down as indicated by an arrow 3. For driving the heald shaft 1, a linkage 4 is provided which is connected to the heald shaft 1 at two or more locations 5, 6 and which constitutes the driven mechanism of the shaft drive 2. The linkage 4 comprises bell crank levers 7, 8 which are connected, on the one hand, with the heald shaft 1 and, on the other hand, directly or indirectly with a push-pull rod 9. The latter is coupled to the shaft drive 2 which, for this purpose, has, at its output, a rocker arm 11 which executes an oscillating motion. The shaft drive 2 generates from the uniform rotary motion of an input shaft 12 the back-and-forth motion designated by an arrow 13. This motion imparts to the heald shaft 1 a substantially harmonic oscillating motion.

Figure 2:
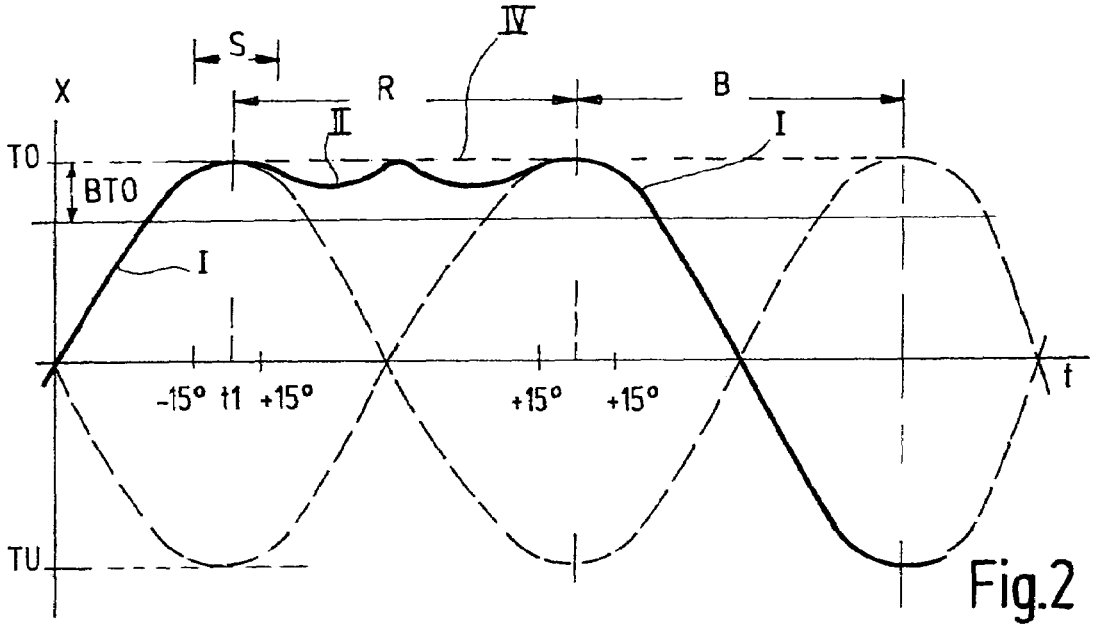
FIGS. 2, 3 are diagrams of the time function for different courses of heald shaft motions in different motion phases.

Turning now to FIG. 2, the curve I describes the motion of the heald shaft along the X-coordinate (in the direction of the arrow 3 of FIG. 1) as a function of time t. The function may be, for example, sinusoidal. As soon as the heald shaft 1 has reached its upper location of reversal TO, where it could pause as far as weaving technology itself is concerned, the curve I changes into an oscillation of reduced amplitude and acceleration (curve branch II). Accordingly, the heald shaft 1, rather than being at a standstill, executes an oscillation in a range BTO of the reversal location. Thus, in the vicinity of the upper maximum, the heald shaft motion changes from curve I to curve II.

By virtue of the designed oscillating motion, the stresses on the heald shaft 1 are reduced or limited to the greatest extent, because such an oscillating motion may maintain the accelerations at a minimum.

Figure 3:
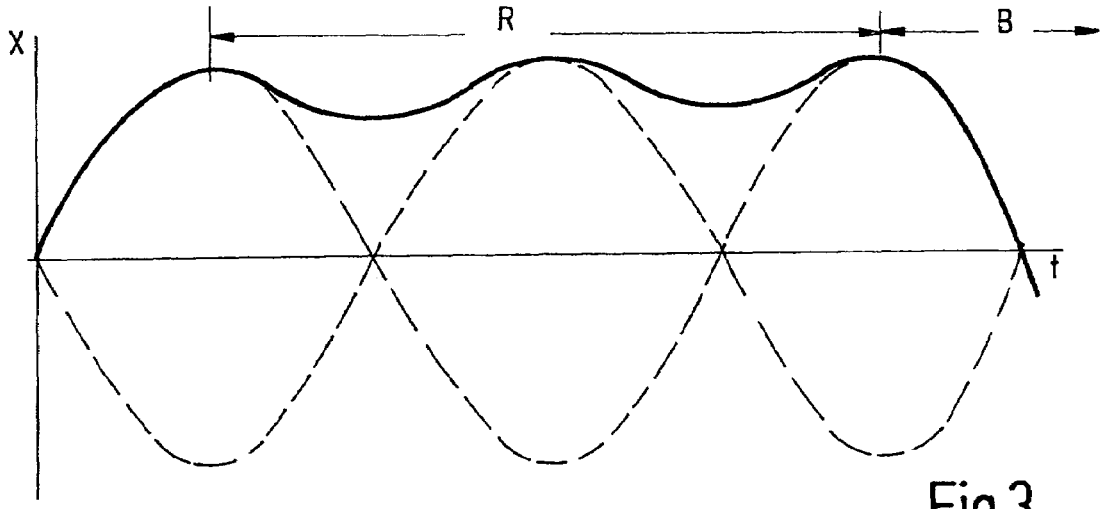

FIG. 3 shows that the reversal point oscillation in the resting region R may be maintained throughout several cycles.

Figure 4:
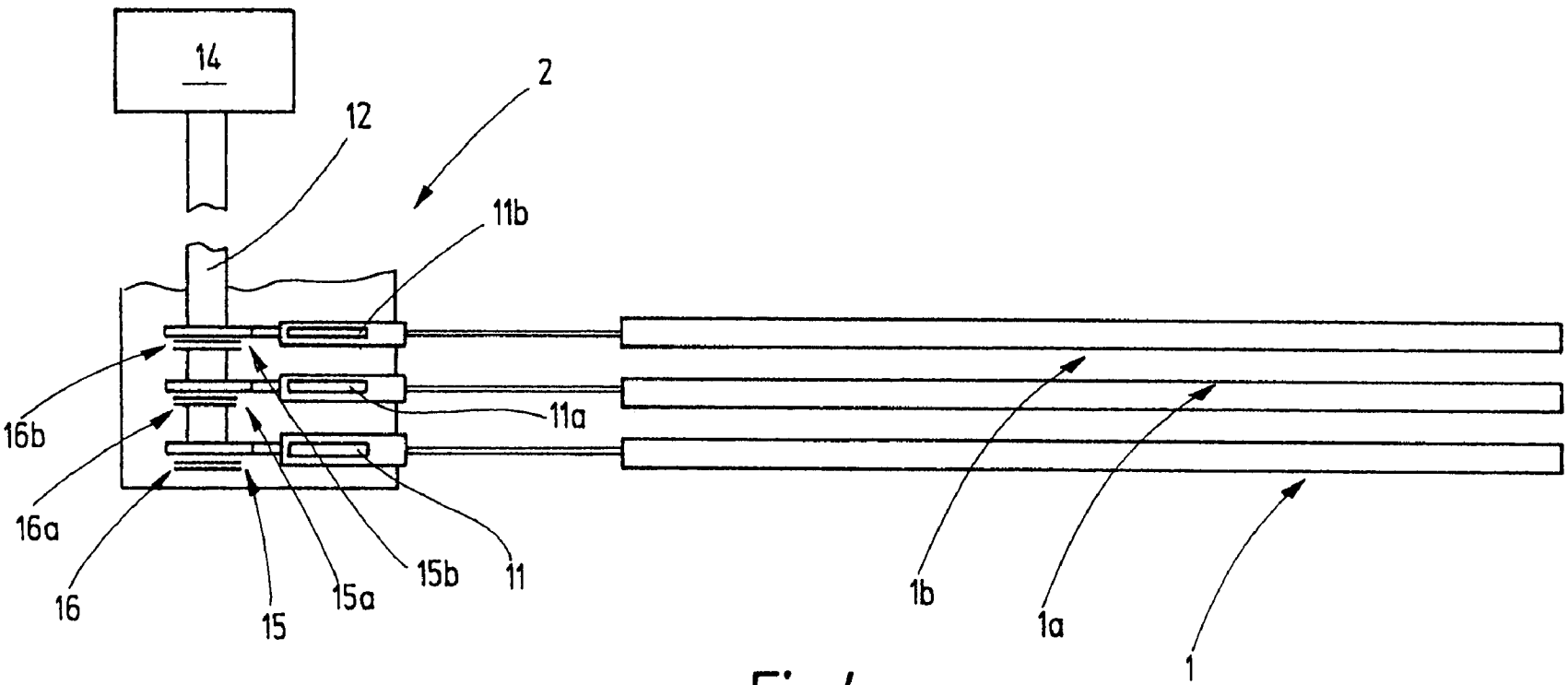
FIG. 4 is a schematic top plan view of the shaft drive shown in FIG. 1.

As illustrated in FIG. 4, several heald shafts 1, 1*a*, 1*b* may be arranged at a small distance behind one another and may be driven from the common shaft drive 2 and thus from the common input shaft 12. The latter is connected with a rotary driving device 14 formed by a servomotor, a usual electric motor or a driven shaft of a central driving device which also drives further components of the weaving machine.

Figure 5:
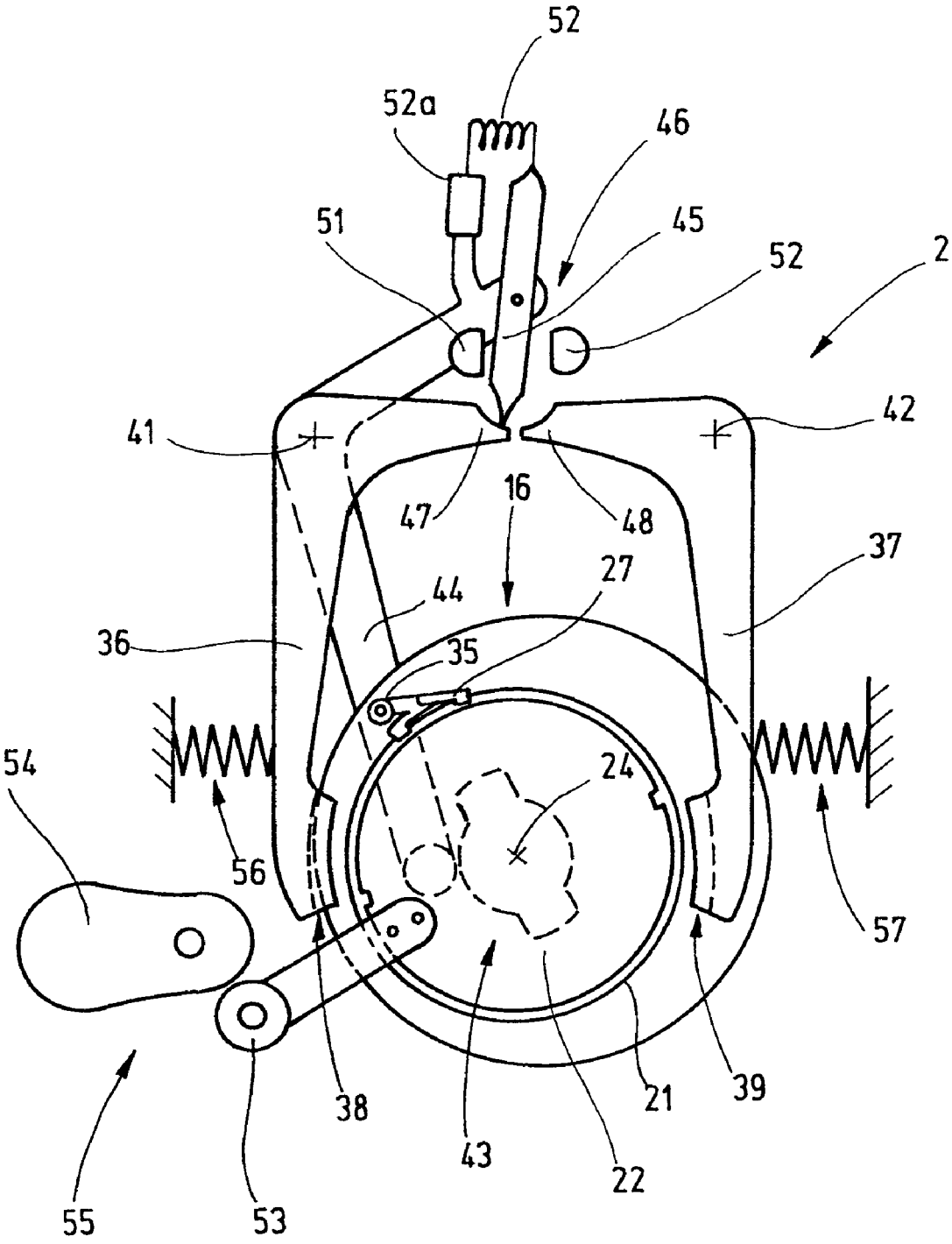
FIG. 5 is a schematic fragmentary view of the shaft drive shown in FIG. 1.
Figure 6:
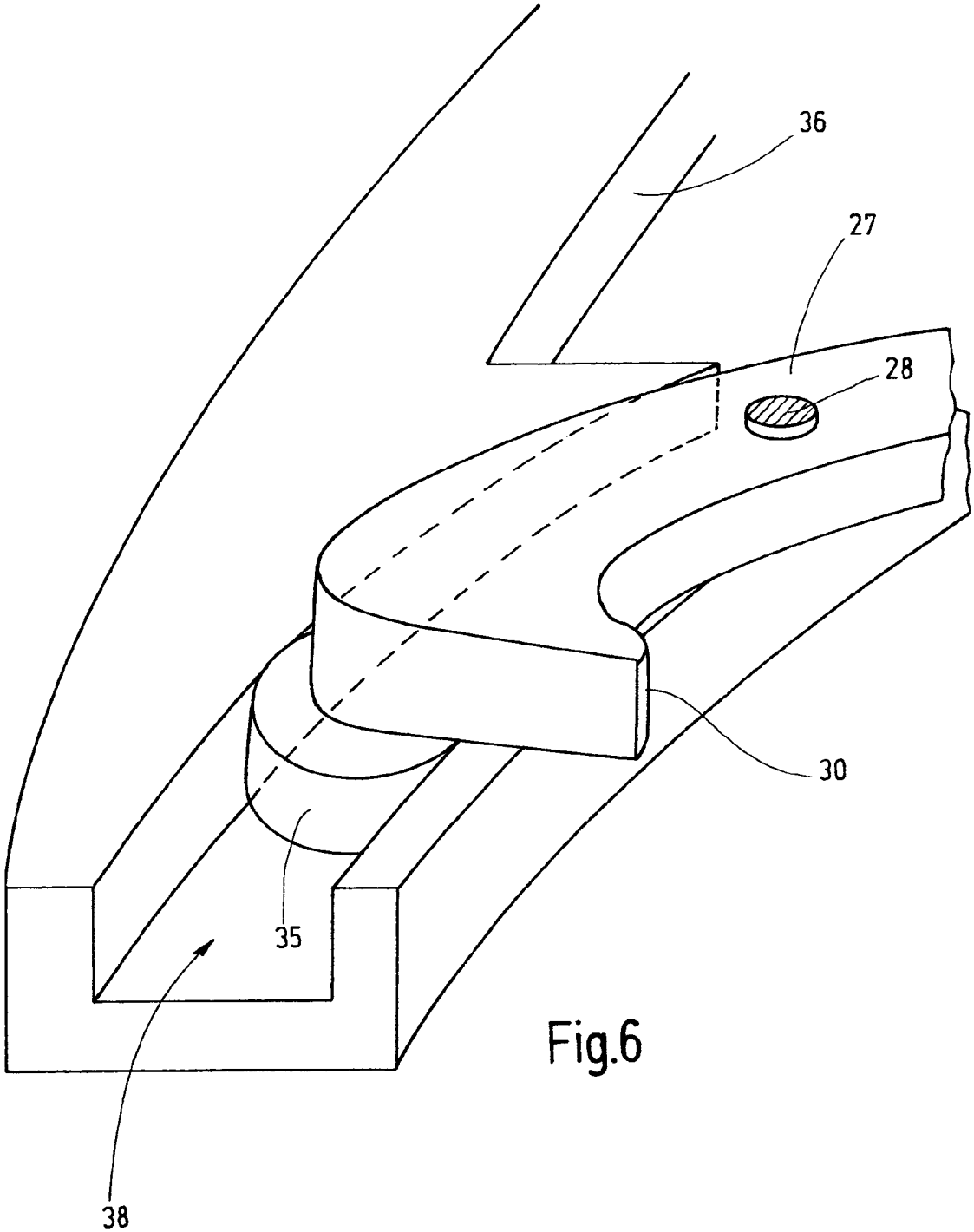
FIG. 6 is a fragmentary perspective view of the slot guide of the shaft drive according to FIG. 1.
Figure 7:
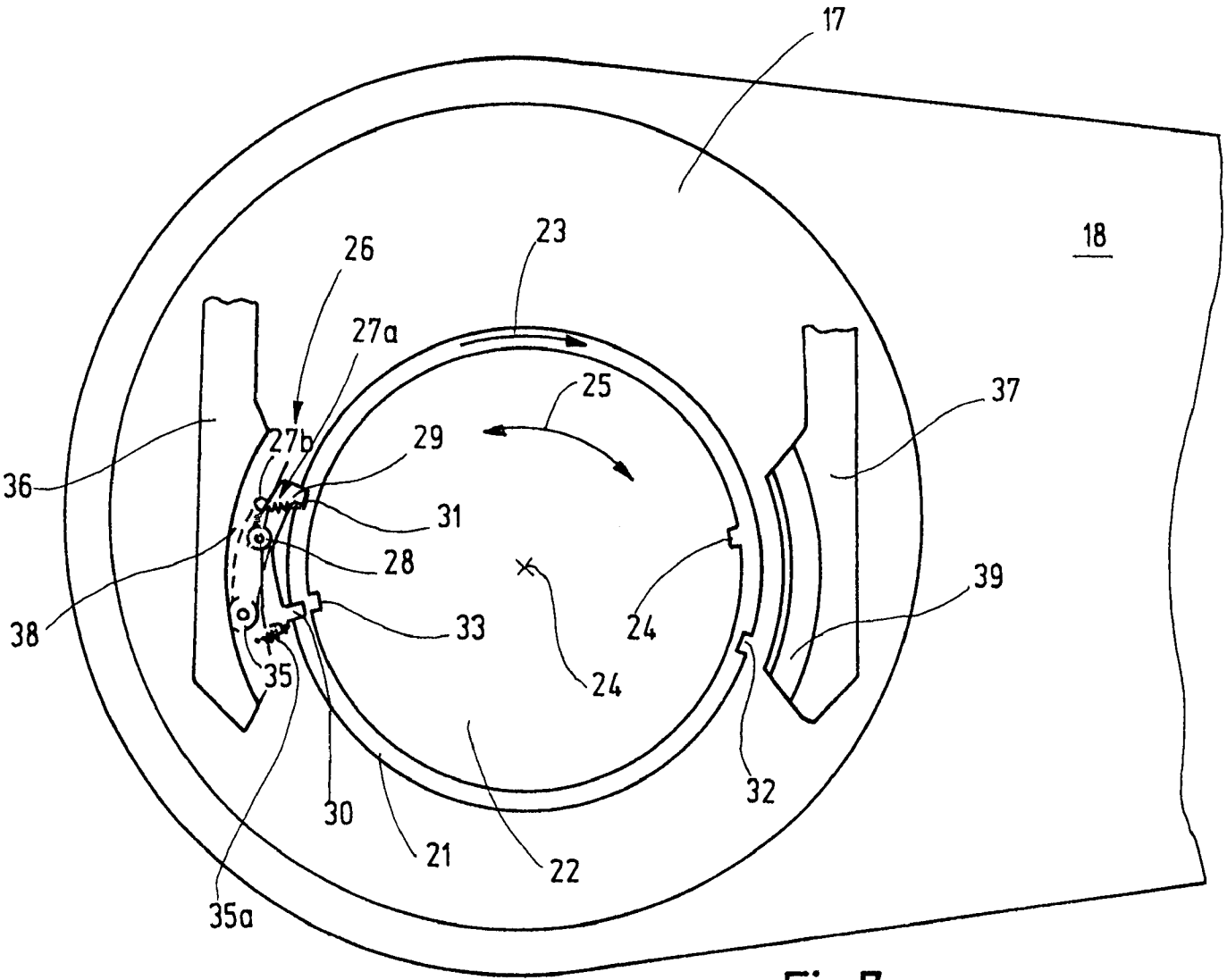
FIG. 7 is a fragmentary schematic illustration, on a different scale, of the shaft drive according to FIG. 5.

The above-discussed movements of the heald shaft 1 in the motion phases B and the resting phases R are generated by the mechanical shaft drive 2 as shown in FIGS. 5, 6 and 7. For each heald shaft 1, 1*a*, 1*b* the shaft drive 2 includes a respective gearing 15 (15*a*, 15*b*) for converting the rotary motion of the input shaft 12 into the back-and-forth motion of the respective, output-side lever 11 (11*a*, 11*b*) constituting an oscillating rocker. The shaft drive 2 further includes, for each heald shaft 1 (1*a*, 1*b*), a clutch device 16 (16*a*, 16*b*) by means of which the gearing 15 is to be selectively connected to or separated from, the input shaft 12. The clutch device 16 and the gearing 15 are shown schematically in FIGS. 5 and 7. The clutch device serves for controlling the motion of the heald shaft and is the control device C formed as a mechanical construction. Its structure (FIG. 7) is as follows:

The gearing 15 is formed by an eccentric 17 which oscillates the lever 11 by a connecting rod 18. Thus, the gearing 15 serves for converting the rotary motion of the eccentric 17 into a reciprocating motion. The clutch device 16 comprises a first disk 21 and a second disk 22 (which are both designated as "driving disks" since they constitute the inputs of the clutch device 16). Both disks 21, 22 have preferably the same diameter. They may, however, have different diameters and are, for improved clarity in FIG. 7, shown as having different diameters. The first disk 21 is connected with the input shaft 12 and thus, by means of the latter, it is coupled to the rotary driving device 14. The disk 21 thus rotates in a uniform manner, substantially at a constant rpm which is indicated by the arrow 23 in FIG. 7. The second disk 22 is rotatably supported about the same rotary axis 24 as the first disk 21; it is, however, not driven in constant rotation, but in a rotary oscillating motion, as indicated by the arrow 25.

The clutch device 16 further includes a switching member 26 formed by a switching pawl 27 which is pivotal about a pin 28 and is supported on the eccentric 17 (which is also designated as a "driven disk", since it constitutes the output of the clutch device). The switching pawl has a first switching lug 29 and a second switching lug 30. The switching lugs 29, 30 are arranged at different sides of the pin 28. With the switching lug 29 two detent recesses 31, 32 are associated which are located 180° apart in the disk 21. With the switching lug 30 two detent recesses 33, 34 are associated which are located 180° apart in the disk 22. By means of a biasing device 35*a* later to be described, the switching pawl 27 is, with its switching lug 29, biased toward or away from the disk 21.

At its end adjacent the switching lug 30, the switching pawl 27 is provided with a control roller 35 which is biased by the spring of the switching pawl 27 radially outward with respect to the rotary axis 24.

Figure 8:
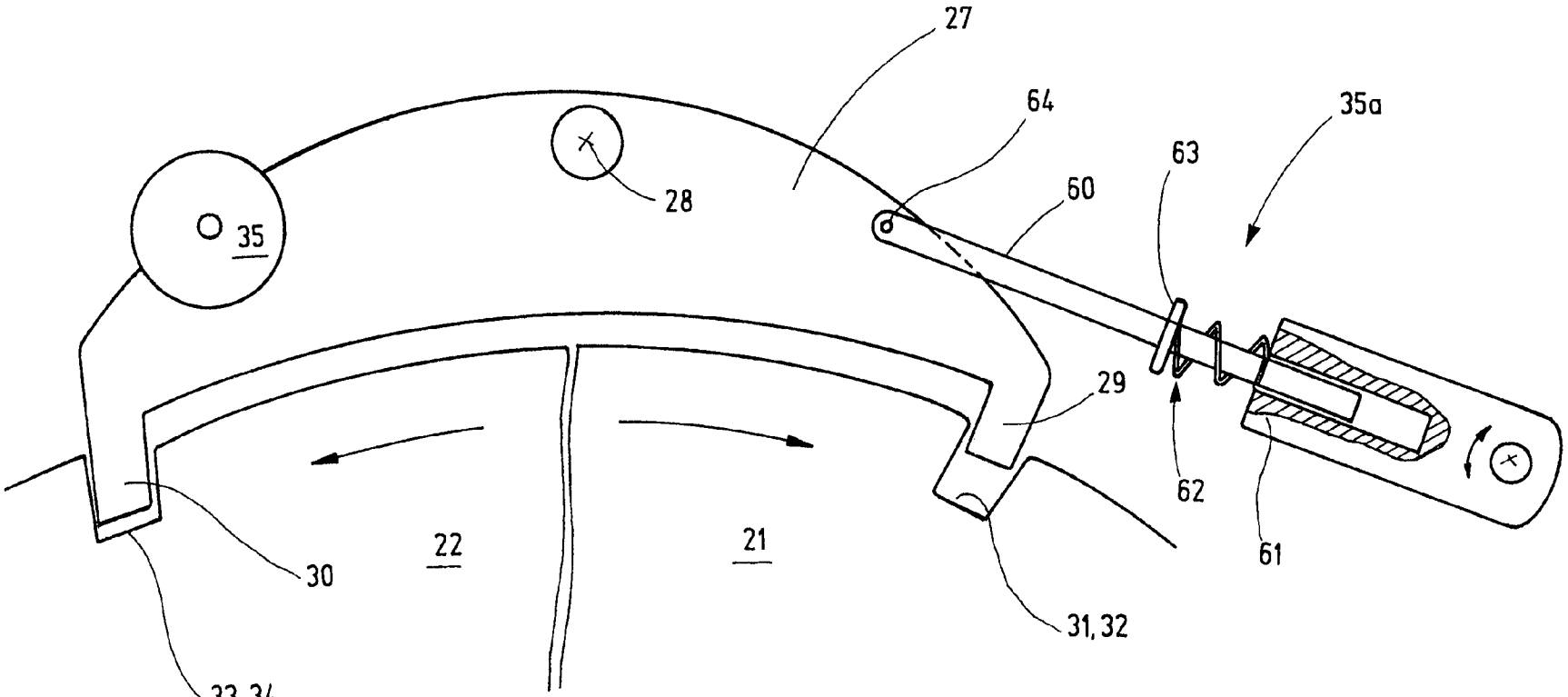
FIG. 8 is a fragmentary illustration of the shaft drive according to FIGS. 1 to 4, showing its switching pawl and a bi-stabile biasing device associated therewith.

The switching pawl 27 is formed, for example, as a rigid rocker as shown in FIG. 6 or 8. The movements of the switching lug 29, 30 are thus rigidly coupled to one another.

It may be furthermore expedient to structure the switching pawl 27 as a two-part component as shown in FIG. 7. The arm 27' carrying the switching lug 29 and the arm 27" carrying the switching lug 30 may rotate independently from one another about the pin 28. Further, the arm 27" may be provided with a projection serving as a seating surface for the arm 27'. A spring may bias the arm 27' against the projection. In this manner, during the synchronized phase in which the disks 21, 22 run briefly in synchronism, both switching lugs 29, 30 may be in their engaged position. The period during which both switching lugs 29, 30 are engaged, can and is allowed to be greater than in case of a single-part construction, due to the division of the switching pawl 27. By relieving of load the respective switching lug 29, 30 to be disengaged, the latter may move out from its detent recess 31, 32 or 33, 34 at a suitable moment.

With the switching pawl 27 two switching levers 36, 37 are associated (FIG. 7), each having a respective, cylindrically arcuate slot guide 38, 39. Each is arranged approximately concentrically to the rotary axis 24 and is formed by an approximately circularly arcuate groove (FIG. 6). The grooves have arcuate flanks, between which the control roller 35 runs. As seen in FIG. 5, the switching levers 36, 37 may be pivoted inward or outward radially about pivot axes 41, 42. The inner pivotal position is selected in such a manner that the switching lug 29 of the switching pawl 27 is, as seen in FIG. 8, lifted out of its respective detent recess 31, 32 when the control roller 35 runs on and along the outer groove flank of the slot guide 38, 39. Then, accordingly, the switching lug 30 engages into the detent recess 33, 34. For moving the switching pawl 27 in the opposite direction against the force of the bi-stabile biasing device 35*a*, the control roller 35 runs on the inner groove flank of the slot guide 38, 39.

For operating the switching levers 36, 37, a cam drive 43 shown in FIG. 5 is provided which is coupled with the input shaft 12 and has, for example, two cams. With the two cams a cam follower lever 44 is associated which is formed as a bell crank lever and which actuates the switching levers 36, 37 by means of a selector finger 45 serving as a control coupling 46. The selector finger 45 is driven in a vertical oscillation by the cam follower lever 44 and thus actuates, dependent on its pivotal position, either the free end 47 of the switching lever 36 or the free 48 end of the switching lever 37. Upon such an occurrence, the respective end 47 or 48 is pressed downward for the duration of the excursion of the cam follower lever 44. To be able to set the pivotal position of the selector finger 45 in a desired manner, on either side thereof abutments 51, 52 are provided which limit the selector finger 45 in its position. The selector finger 45 is pulled to and maintained at, the abutment 52 by a control magnet 52*a* against the force of a compression spring 52*b* when the control magnet 52*a* is actuated for performing its control function. Otherwise the compression spring 52*b* presses the selector finger 45 against the abutment 51 and holds it there.

While the disk 21 is constantly rotated, the disk 22, as noted before, performs a rotary oscillation. For this purpose a cam follower 53 (FIG. 5) is provided which is coupled with the disk 22. The cam follower 53 may be a roller supported at the end of a lever rigidly affixed to the disk 22. The cam follower 53 is actuated by a cam disk 54 which rotates, for example, at twice the rpm of the input shaft 12 and has only a sole elevation. In this manner for each revolution of the input shaft 12 two back-and-forth oscillations are imparted on the disk 22.

The above-described shaft drive 2 operates as follows:

It is initially assumed that the eccentric 17 is to perform a constant rotation. For this purpose the switching pawl 27 must constantly connect the disk 21 with the eccentric 17. For achieving this result, the switching lever 36 and the switching lever 37 have to move outward in each instance when the switching pawl 27 passes by the respective switching lever as the disk 21 rotates. For this purpose the control magnet 52*a* is controlled in such a manner that the selector finger 45 presses the end 47 downward when the switching pawl 27 passes by the switching lever 36 and that the selector finger 45 presses the end 48 downward when the switching pawl 27 passes by the switching lever 37.

The switching surfaces 38, 39 of the switching levers 36, 37 extend over an angle range which may be regarded as a switching range. The cam follower 53, together with the cam disk 54 forms an oscillating drive 55. The latter imparts to the disk 22 a rotary oscillating motion which is in synchronism with the motion of the disk 21 at all times when the switching pawl 27 passes through the switching range. These motion phases are characterized by the fact that the cams of the cam drive 43 displace outward the end of the cam follower lever 44.

During the phase of synchronous run of the disks 21, 22, the clutch device 16 may be switched over, by providing that the respective switching lever 36 or 37 does not move outward. In this manner, for example, the switching lug 29 is pressed out of the detent recess 31, while the switching lug 30 is engaged into the detent recess 33. The respective switching lever 36 or 37 remains activated by holding the respective switching lever 36 or 37, for example, by the springs 56, 57, in its inward position and is not moved outward by the selector finger 45. In this state the eccentric 17 performs only a back-and-forth oscillating motion, since it is tied to the disk 22. The back-and-forth oscillating motion of a few degrees (for example, 10°) effects in the upper and lower reversal points of the heald shaft only a slight (a few millimeters at the most) up and down motion thereof. Such a motion does not disturb the shed building and weaving process. It permits, however, a synchronous, new switch-over by virtue of the fact that only the respective switching lever 36, 37, at which the switching pawl 27 dwells, is pivoted outward. The cam drive 43 causes this occurrence at the moment when the two disks 21, 22 are synchronized, so that a soft, shock-free restart of the eccentric 17 results.

Figure 9:
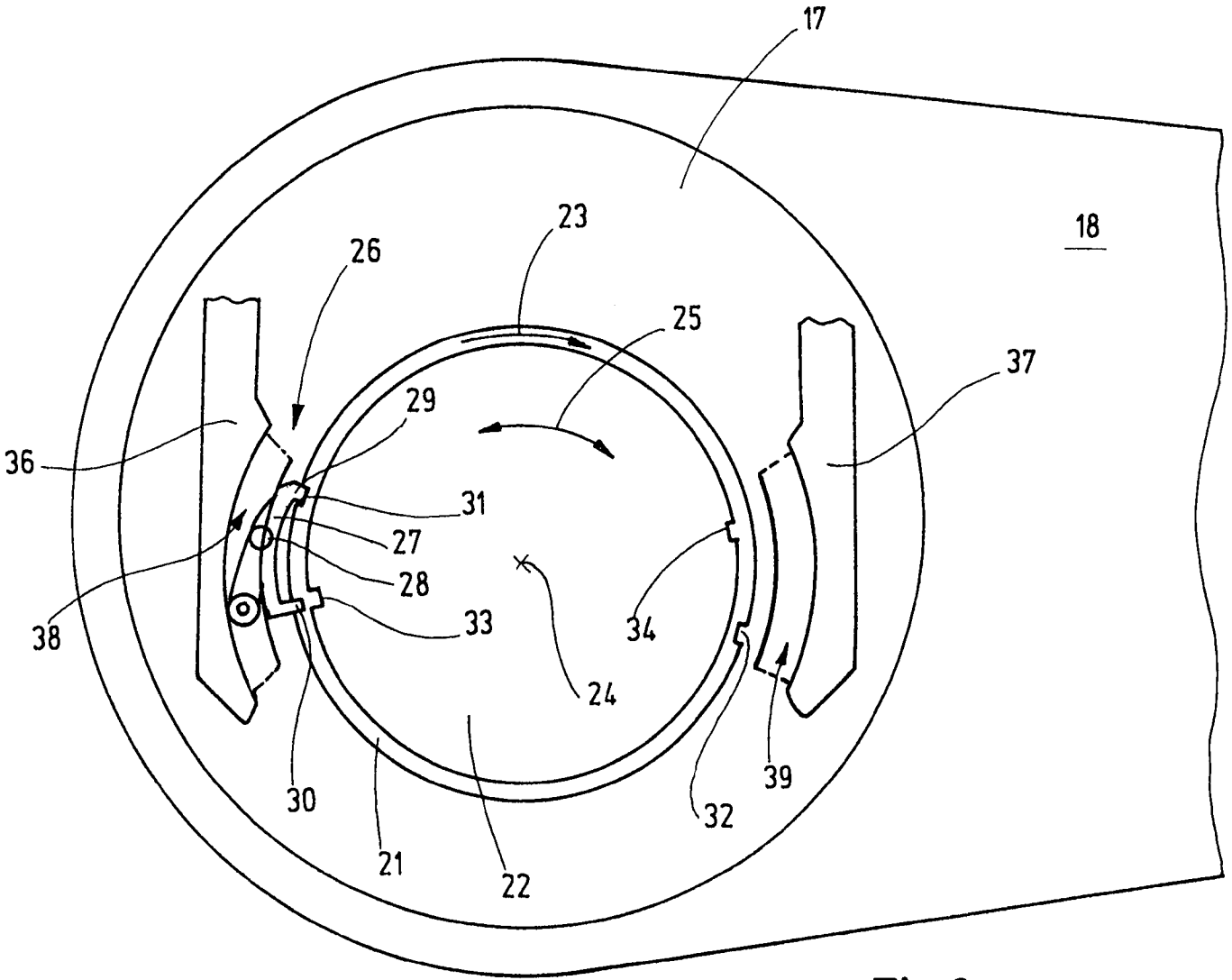
FIG. 9 is a schematic illustration of a shaft drive having switchable cam disks, a bi-stabile switching pawl and slot guides.

The biasing device 35*a* biases the switching pawl 27 in two stabile positions. FIG. 8 illustrates an exemplary embodiment in which a push rod 60 engages an arm of the switching pawl 27 and is held in a counter support 61. The latter is rotatably and stationarily connected with the bearing of the pin 28 and is thus mounted, for example, on the eccentric 17. A spring 62, such as a compression spring, which is mounted on the push rod 62, engages with one end the counter support 61 and with its other end a washer 63 secured to the push rod 60. The push rod 60 is connected with the switching pawl 27 by means of a joint 64. The counter support 61, the joint 64 and the pin 28 are arranged in such a manner that the switching pawl 27 and the push rod 60 travel through an extended position when they move through a pivotal range of the switching pawl 27. Such an extended position constitutes a dead-center position. At either side of the dead-center position the switching pawl 27 has stabile, engaged positions. In one of the engaged positions the switching lug 29 engages into the detent recess 31, while in the other stabile position the switching lug 30 engages into the detent recess 33. In this manner the switching pawl 27 securely retains its coupling position assigned thereto by the control roller 35. The switching pawl 27, as illustrated in FIGS. 8 and 9, may be a rigid part or, as shown in FIG. 7, it may be a two-piece component. In either case the switching pawl 27 is switched by the switching lever 36, 37 into the respective stabile switching position predetermined by the bi-stable biasing device 35*a*.

Figure 10:
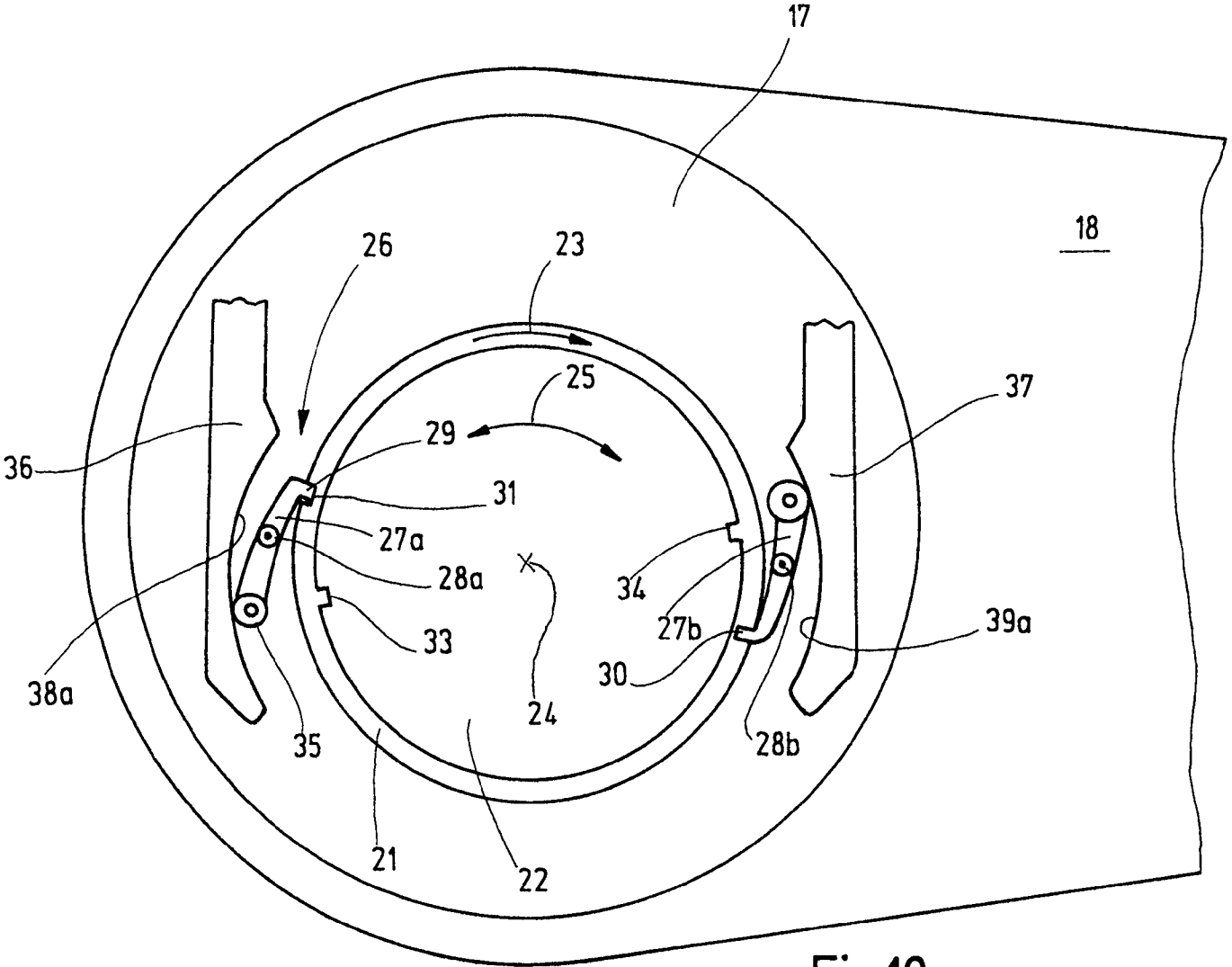
FIG. 10 is a schematic illustration of a shaft drive having two single-lug switching pawls.
Figure 11:
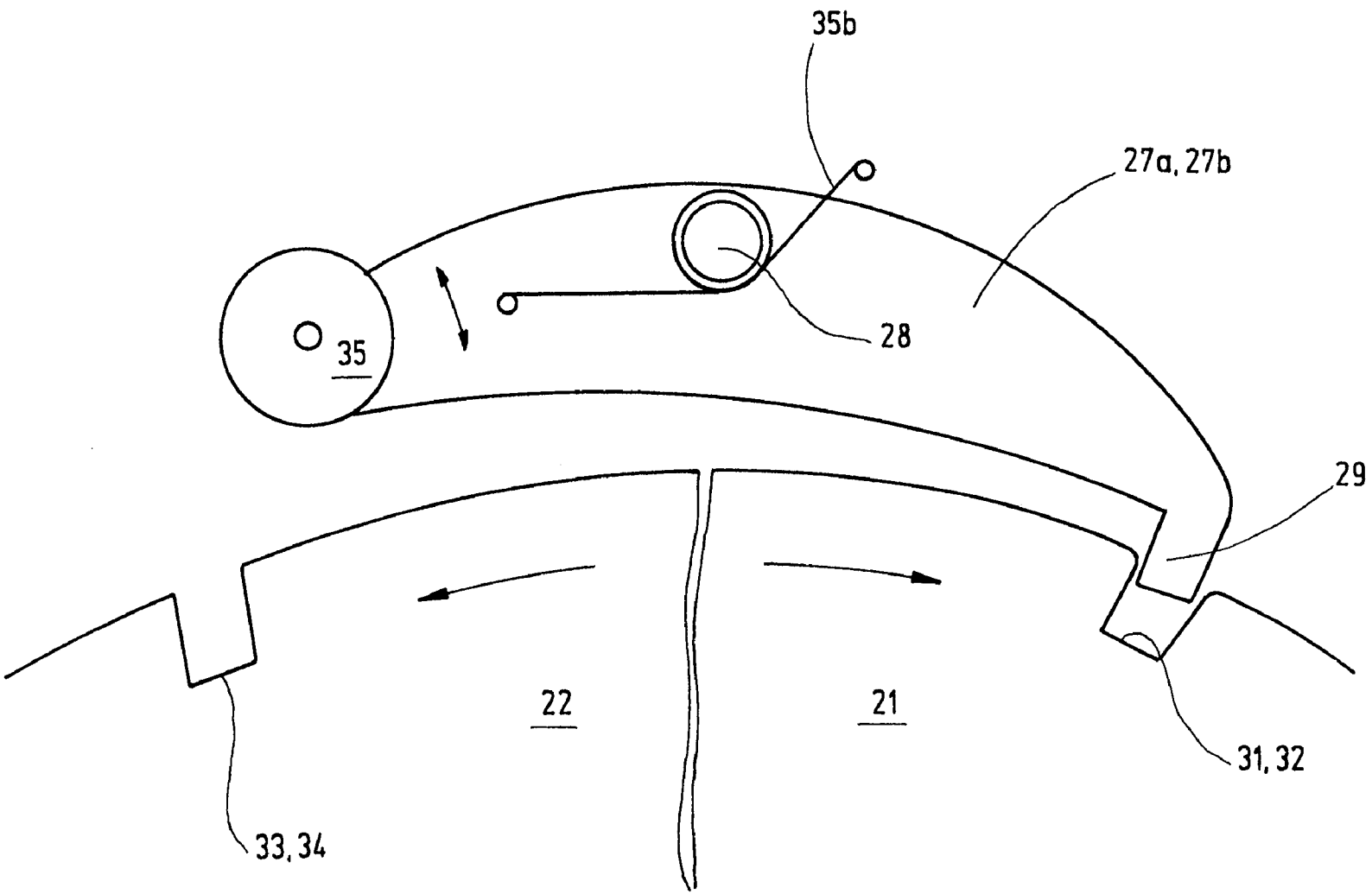
FIG. 11 is a fragmentary illustration of the shaft drive of FIG. 10, showing one of its single-lug switching pawls.

FIG. 10 shows a further variant in which the shaft drive uses switching pawls 27*a*, 27*b* which, similarly to the earlier-described switching pawl 27, are each pivotally supported on the eccentric 17 by means of a respective pin 28*a*, 28*b*. Each switching pawl 27*a*, 27*b* carries only a sole switching lug 29, 30. In this manner the switching pawl 27*a* is associated with the disk 21 and the switching pawl 27*b* is associated with the disk 22. The switching pawls 27*a*, 27*b* are biased toward their detent positions by springs, such as a wrap spring 35*b* shown in FIG. 11. The switching pawl 27*a* is in engagement with the disk 21. The switching pawl 27*b* is disengaged from the disk 22. For moving the switching pawls 27*a*, 27*b* out of their detent position, the switching levers 36, 37 or more precisely, their cylindrically arcuate switching surfaces 38*a*, 39*a* are provided, replacing the slot guides 38, 39 of the switching device shown in FIG. 6.

The embodiment in which separate switching pawls 27*a*, 27*b* are used, provides for an engagement of the desired switching pawl 27*a* or 27*b* independently of how fast the respective other switching pawl 27*a* or 27*b* arrives into its disengaged position.

Figure 12:
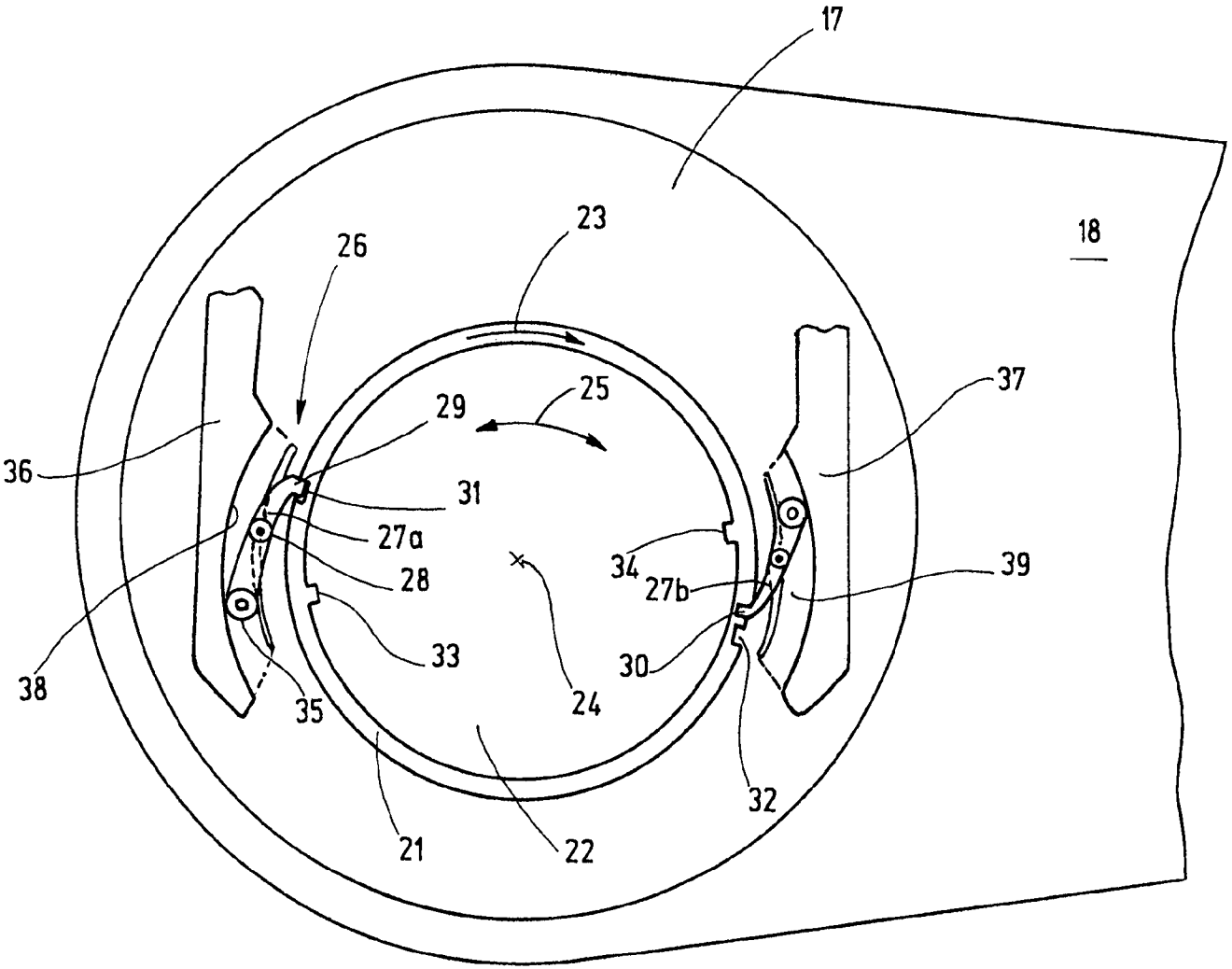
FIG. 12 is a schematic illustration of a shaft drive having two single-lug switching pawls and slot guides.
Figure 13:
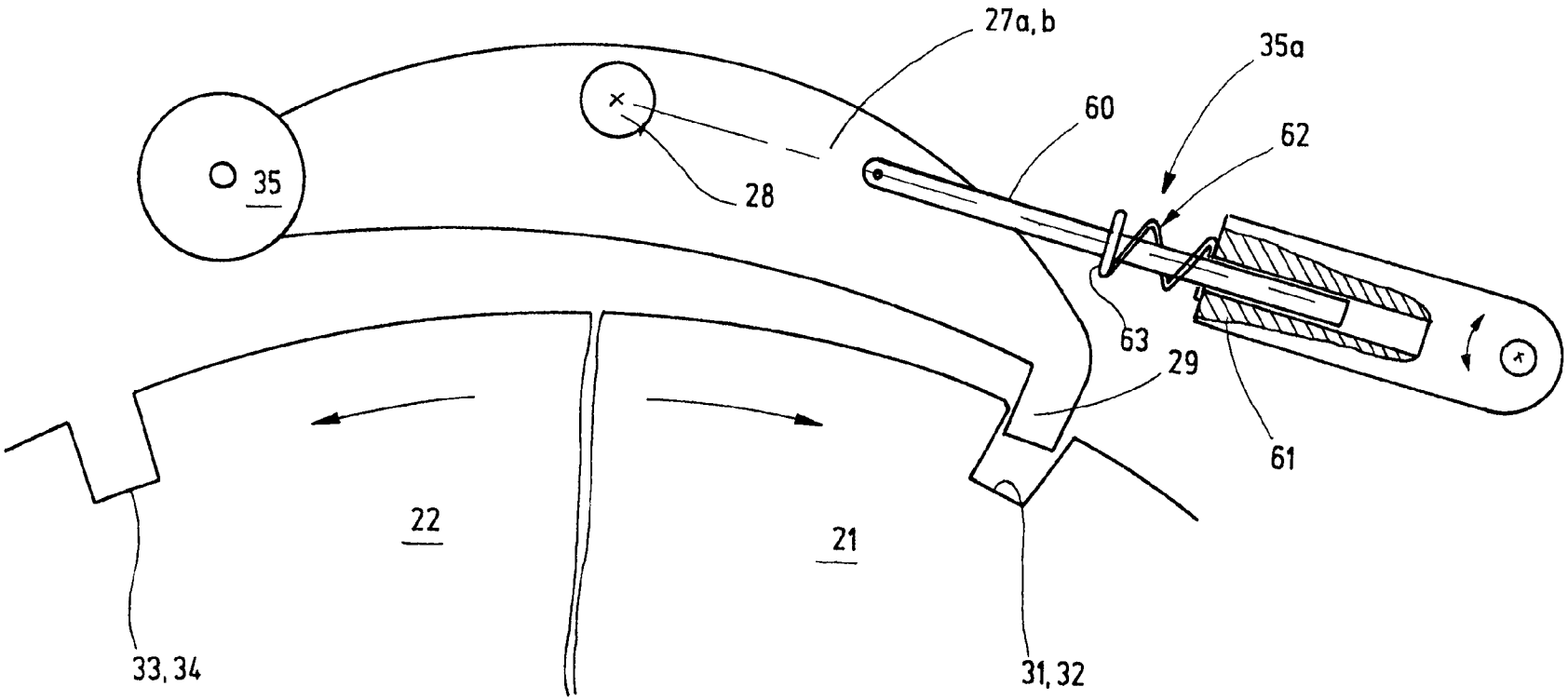
FIG. 13 is a fragmentary illustration of the shaft drive of FIG. 12, showing its bi-stabile, single-lug switching pawls.

As illustrated in FIG. 12, the switching pawls 27*a*, 27*b* may also be actuated by slot guides 38, 39. For this purpose the switching pawls 27*a*, 27*b* according to FIG. 11, as well as the switching pawls according to FIG. 13 may find application. Further, as shown in FIG. 10, the switching pawls 27*a*, 27*b* may pivot in the same direction. The switching pawls 27*a*, 27*b* according to FIG. 13 are each provided with a bi-stabile biasing device 35*a*, as it was earlier described in connection with FIG. 8. Accordingly, that description applies in this instance.

Figure 14:
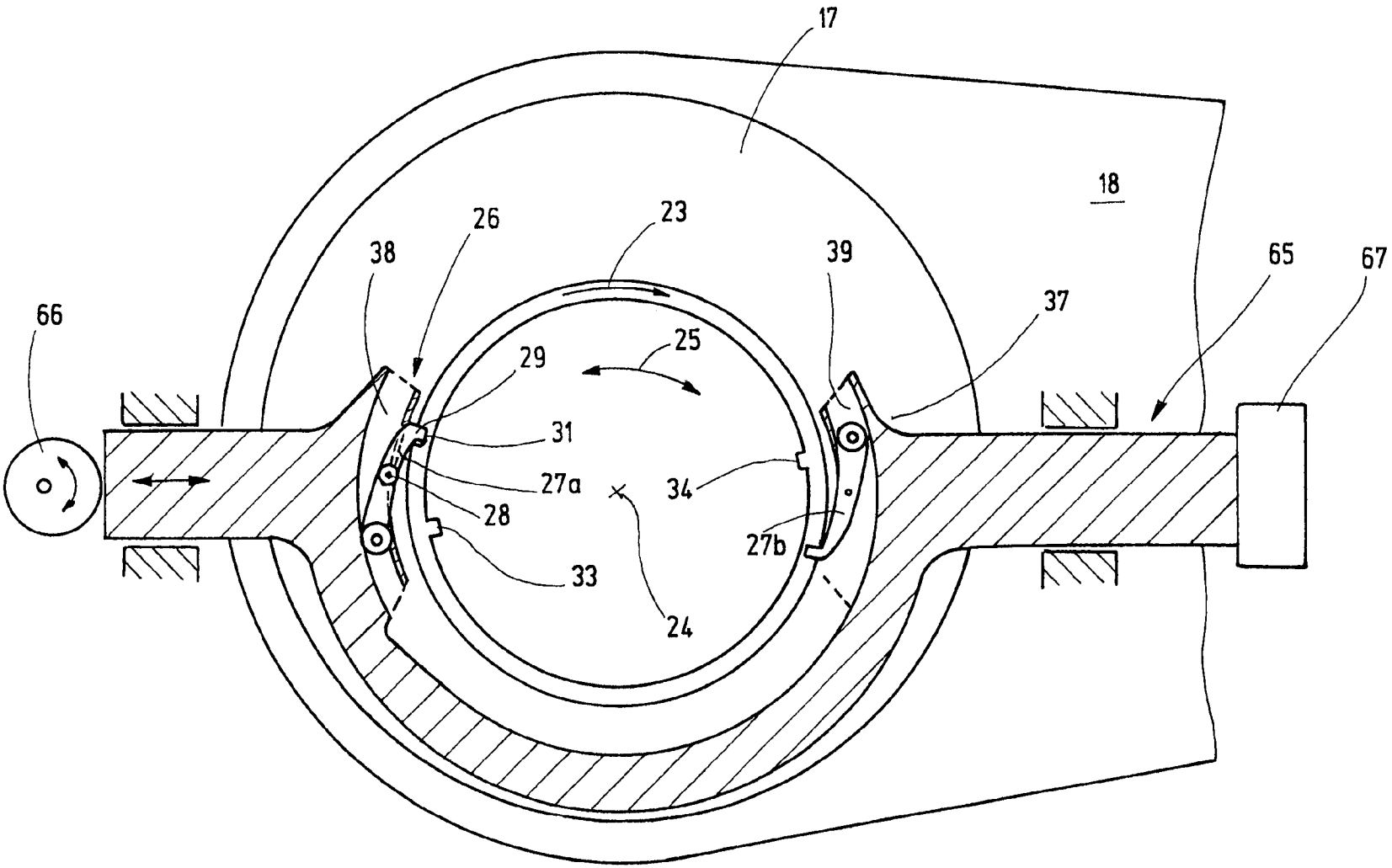
FIG. 14 is a schematic illustration of a shaft drive having two single-lug, bi-stabile switching pawls according to FIG. 13 and an actuating slider.

The switching pawls 27*a*, 27*b* may be actuated either by the switching levers 36, 37 or by a slider 65 on which the two slot guides 38, 39 are formed. The slider 65 may be supported to be slidable, for example, in a selected radial direction relative to the rotary axis 24 and, as shown in FIG. 14, may be actuated by a control cam 66. The slider 65 ensures a synchronous switching of both switching pawls 27*a*, 27*b*, so that even at high switching speeds a faulty switching is avoided.

Further, with the slider 65 a holding magnet 67 may be associated for maintaining the slider 65 in an end position.

A new shaft drive provides for a switch-on and switch-off of individual heald shafts even at high working speeds. For this purpose switching pawls are provided which couple an eccentric with permanently revolving and/or back-and-forth oscillating disks. Measures for improving the controllability of such a clutch device are the control of the switching pawls by slot guides, associating bi-stabile biasing devices with the switching pawls and/or dividing the switching function into individual switching pawls 27*a*, 27*b* which are associated individually with differently running disks 21, 22. Preferably, one of the two disks executes a continuous rotary motion, while the respective other disk performs only an oscillating motion which determines the heald shaft motion during the resting phases thereof.

It will be appreciated that the above description of the present invention is susceptible to various modifications, changes and adaptations, and the same are intended to be comprehended within the meaning and range of equivalents of the appended claims.

LIST OF REFERENCE CHARACTERS

1, 1*a*, 1*b* heald shaft
95 heald
2 shaft drive
3 arrow
4 driven device (for example, linkage)
5, 6 locations
7, 8 bell crank lever
9 push-pull rod
11 rocker
12 input shaft
13 arrow
14 rotary driving device
15 gearing
16 clutch device
17 eccentric
18 connecting rod
21, 22 input element/disk
23 arrow
24 rotary axis
25 arrow
26 switching member
27 switching pawl
27', 27" switching pawl arms associated with the disk 21, 22
27*a*, 27*b* switching pawl
28, 28*a*, 28*b* pin
29, 30 switching lugs
31, 32, 33, 34 detent recesses
35 control roller
35*a* biasing device
35*b* wrap spring
36, 37 switching lever
38, 39 slot guide
38*a*, 39*a* switching surface
41, 42 pivotal axis
43 cam drive
44 cam follower lever
45 selector finger

46 control coupling
47, 48 end
51, 52 control magnets
52*a* control magnet
52*b* compression spring
53 cam follower
54 cam disk
55 oscillation drive
56, 57 springs
60 push rod
61 counter support
62 spring
63 disk
64 joint
65 slider
66 control cam
67 holding magnet
B motion phases
C control device
TO, TU location of reversal, point of reversal
BTO zone of reversal point
t time
R resting phase
S synchronous phase

What is claimed is:

1. A shaft drive for at least one heald shaft of a weaving machine, comprising:

at least one driven device associated with the heald shaft and connected therewith for maintaining the heald shaft in resting phases and for imparting motion phases thereto, a control device for controlling the actual speed of the driven device and thereby that of the heald shaft, a clutch device forming part of the shaft drive and arranged between a driving device and a gearing for transmitting the driving motion to the heald shaft, wherein the clutch device has a first driving disk connected with the driving device and a second driving disk, as well as a driven disk, to be connected selectively with the first or the second driving disk by means of at least one switching pawl, and wherein the switching pawl is held by a bi-stabile biasing device for movement back-and-forth between two stabile positions, with the bi-stable biasing device including a push rod having one end pivotally connected to the switching pawl and its other end slidingly supported in a pivotally mounted counter support such that the push rod forms a straight line with a pivot point of the switching pawl, and a compression spring mounted on the push rod and supported between the counter support and a washer secured to the push rod.

2. The shaft drive as defined in claim 1, wherein the switching pawl is movable back-and-forth between an engaged position and a disengaged position by an actuating element having a slot guide.

3. The shaft drive as defined in claim 2, wherein the slot guide enters into engagement with the switching pawl only in selected rotary positions of the driving device.

4. The shaft drive as defined in claim 2, wherein the actuating element is an actuating slider.

5. The shaft drive as defined in claim 1, wherein the driving device imparts a motion of constant direction to the first driving disk, and that a motion of alternating direction is imparted to the second driving disk.

6. The shaft drive as defined in claim 1, wherein the driven device (4) executes a predetermined motion also during the resting phases.

7. The shaft drive as defined in claim 1, wherein the predetermined motion in the resting phases is determined by the control device.

8. The shaft drive as defined in claim 1, wherein at the beginning of a resting phase the driven device has an acceleration which equals to its acceleration at the end of the preceding motion phase.

9. The shaft drive as defined in claim 1, wherein at the beginning of a motion phase the driven device has an acceleration which equals to its acceleration at the end of the preceding resting phase.

10. The shaft drive as defined in claim 1, wherein the driven device executes an oscillating motion during the resting phases.

11. The shaft drive as defined in claim 1, wherein the first driving disk and the second driving disk are at least briefly synchronously driven and that a switch-over of the clutch device is effected during the synchronous phase.

12. The shaft drive as defined in claim 1, wherein the second driving disk is connected with an oscillating drive which imparts an oscillating motion to the second driving disk.

13. The shaft drive as defined in claim 1, wherein the switching pawl is permanently coupled to the eccentric and is selectively coupled to the first or the second driving disk.

14. The shaft drive as defined in claim 12, wherein the rotary oscillating motion of the second driving disk at the switching positions predetermined by an actuating element is in synchronism with the rotary motion of the first driving disk.

15. The shaft drive as defined in claim 2, wherein the actuating element is formed by at least one switching lever associated with the switching pawl for engaging or disengaging the switching pawl at least in one predetermined switching position.

16. The shaft drive as defined in claim 1, wherein the switching pawl is connected with the driven disk and co-rotates therewith.

17. The shaft drive as defined in claim 16, wherein the switching pawl is movable back-and-forth between an engaged position and a disengaged position by an actuating element having a slot guide, and the actuating element is connected with a cam drive by means of a control coupling.

18. The shaft drive as defined in claim 17, wherein the control coupling includes a selector finger which is supported for displacement between at least two positions, for effecting an activation and de-activation of the actuating element by the cam drive and that the selector finger is movable by a combination of a control magnet and a compression spring.

* * * * *